US008056892B2

(12) United States Patent
Honegger

(10) Patent No.: US 8,056,892 B2
(45) Date of Patent: Nov. 15, 2011

(54) APPARATUS FOR COLLATING FLAT OBJECTS AND FOR CONVEYING THE COLLATED OBJECTS FURTHER

(75) Inventor: Werner Honegger, Bach (CH)

(73) Assignee: Ferag AG, Hinwil (CH)

( * ) Notice: Subject to any disclaimer, the term of this patent is extended or adjusted under 35 U.S.C. 154(b) by 326 days.

(21) Appl. No.: 12/161,885

(22) PCT Filed: Jan. 19, 2007

(86) PCT No.: PCT/CH2007/000026

§ 371 (c)(1),
(2), (4) Date: Aug. 22, 2008

(87) PCT Pub. No.: WO2007/085101

PCT Pub. Date: Aug. 2, 2007

(65) Prior Publication Data

US 2009/0020938 A1 Jan. 22, 2009

(30) Foreign Application Priority Data

Jan. 25, 2006 (CH) ..... 0118/06

(51) Int. Cl.
*B65G 47/22* (2006.01)
*B65H 39/06* (2006.01)

(52) U.S. Cl. ..... 270/58.23; 270/52.14; 270/52.16; 270/52.19; 270/58.07; 270/58.29

(58) Field of Classification Search ..... 270/52.14, 270/52.16, 52.19, 52.2, 52.21, 52.22, 58.01, 270/58.07, 58.23, 58.25, 59.29; 271/292, 271/294, 295, 9.01, 9.12, 9.13; 198/418.2, 198/418.3, 431
See application file for complete search history.

(56) References Cited

U.S. PATENT DOCUMENTS 1,861,406 A 5/1932 Cook
2,561,070 A 7/1951 Phythian

FOREIGN PATENT DOCUMENTS

DE 3737282 A1 5/1988
EP 0292458 A1 11/1988
GB 1444487 7/1976

*Primary Examiner* — Leslie A Nicholson, III
(74) *Attorney, Agent, or Firm* — Rankin, Hill & Clark LLP

(57) ABSTRACT

Different printed products (10) are fed by feeding units (7) and collated in compartments (2), wherein the compartments (2) are conveyed substantially continuously past the feeding outlets (6) arranged successively in a line, and a printed product (10) is added through each feeding outlet (6). The compartments (2) have a compartment base (3) and a transverse wall (4), wherein the compartment base (3) is inclined at least in a feeding region (5) of a circuit (1) of the compartments (2) in a conveying direction and the transverse wall (4) is upstream or downstream depending on the direction of inclination of the compartments. The compartments (2) are coupled to a conveying means such that they are rotatable around a substantially horizontal and/or substantially vertical axis. Thus, it becomes possible to maintain the inclination angle of the compartments which they have in the feeding region, in a region (12) for conveying further, an extraction region (15) with inclining or declining gradients.

19 Claims, 4 Drawing Sheets

APPARATUS FOR COLLATING FLAT OBJECTS AND FOR CONVEYING THE COLLATED OBJECTS FURTHER

BACKGROUND OF THE INVENTION

The invention is in the field of the processing of piece goods. The device serves the purpose of collating flat objects and conveying them further, wherein the flat objects are in particular printed products.

Collating printed products is understood by the expert as placing different printed products on top of each other to form stacks, wherein normally, identical printed products are superposed in the same succession in all stacks, the stacks, however, may differ in that in individual stacks individual printed products are not present. The printed products are e.g. individual, not folded or folded sheets or kerfs folded several times and the printed products collated to form a stack differ from each other in their printed contents, and may, however, also differ in their shape.

Devices for collating printed products include a plurality of feeding units as well as collating means. Each feeding unit is equipped for the feeding of printed products of a single type into the collating means and the collating means is equipped for the forming of the stacks from the fed printed products. The outlets of the feeding units directed towards the collating means are substantially arranged in a successive line and the collating means comprise a line of compartments for accommodation of the fed printed products, wherein the line of feeding outlets are in parallel to the line of the compartments. During the feeding steps, one compartment is aligned to each feeding outlet. Furthermore, the collating means is equipped for conveying of the fed printed products in a collating direction parallel to the two named lines. The conveying units are e.g. feeders, winding stations or on-line connections with devices in which the printed products to be collated are compiled or processed.

In collating devices in which the printed products are fed into the collating means substantially horizontally to the collating direction, the compartments are normally stationary during the feeding steps and the printed products are moved or tossed into the compartments directed towards the feeding outlets from the side. Between successive feeding steps, the printed products together with the compartments are moved in the collating direction over the distance between successive feeding outlets (or by an integral fraction of this distance), such that the compartments directed towards the feeding outlets are replaced by succeeding compartments. The compartments of such devices are normally arranged such that the printed products come to lie horizontally inside them. In publication U.S. Pat. No. 2,561,070, such a device is described, the compartments of which include one corner which is lower down than the other three corners, such that the printed products deposited therein are aligned to one another at this corner by gravity.

Collating devices, the compartments of which are always stationary, are also known. In this kind of device the printed products fed into the compartments are, between feeding steps, moved with the aid of a slider from the compartment they were fed to through the succeeding compartments, such that all printed products fed in the preceding step are in one compartment which is arranged ahead of the foremost feeding outlet. In order for the printed products moved from compartment to compartment to be stacked regularly in such a device, it is necessary for the printed products to lie oblique in the collating direction, i.e. that the bases of the compartments are arranged in a corresponding oblique manner. Collating devices with the described totally stationary compartments with oblique bases in the collating direction are e.g. described in publications U.S. Pat. No. 1,861,406, GB-1444487 or EP-0292458.

The disadvantages of the collating devices described in short above, in which the compartments are stationary during the feeding, are in particular based on the thus necessary intermittent operation in which large mass needs to be moved and stopped in relatively fast sequences. This means high energy input, high mechanical wear and restricted conveying speeds and, thus, restricted output.

Collating devices with compartments moving substantially continuously in the collating direction do not have the named disadvantages. For a problem-free feeding of the printed products into continuously moving compartments the printed products must, however, be substantially aligned and moved or tossed into the compartments in a precisely synchronized manner, wherein also their speed must be adapted to the conveying speed of the compartments. The collating means of known such devices is e.g. a conveying belt with partitions arranged crosswise and possibly lengthwise to the belt length, wherein two neighboring partitions define one compartment. In these compartments the fed printed products are stacked lying on the conveying belt. Further known collating devices with continuously conveyed compartments comprise V- or L-shaped compartments in which the fed printed products stand on one edge and lean on walls upstream and downstream in the collating direction.

Continuously conveyed compartments, in which the printed products are stacked in a lying manner are simple to implement (e.g. conveying belt with transverse partitions) and they do not require a high accuracy in feeding because they have large openings and may possibly be larger than the printed products to be fed. Because the compartments must be of relatively large dimensions in the collating direction, high conveying speeds become necessary for high output, which restricts application of the device. Furthermore the stacked printed products in the compartments, especially when these are larger than the printed products, are not actually supported and the stacks are, thus, not stabilized, which, in particular, for a further conveying with accelerations and/or changes of direction, may lead to increased effort required when extracting the stacks from the compartments or further processing of the stacks.

V- or L-shaped compartments may be conveyed in much closer succession, such that for an equal output the necessary conveying speeds are much lower. Furthermore the printed products stand on one edge in these compartments and automatically remain aligned to one another in relation to this edge due to gravity. On the other hand, the openings of the compartments are considerably narrower and a relevantly larger accuracy is required in feeding, not only such that the mostly unguided, downstream edge of a printed product to be fed meets the compartment opening in the first place, but in particular that this downstream edge may be safely led past the upper edges of products already stacked in the compartment. The named high feeding speed restricts the conveying speed and, thus, the output of the correspondingly equipped collating device. The compartments are possibly also to be equipped with supporting means by which products already stacked within are pressed against a wall in order not to not conflict with a further printed product to be fed. With this kind of means the compartments become elaborate and complicated regarding the device and its control.

BRIEF SUMMARY OF THE INVENTION

The invention now has the object to create a device for collating of flat objects, in particular printed products for continuous operation and for conveying the collated objects further, wherein the device is to be implemented with the simplest means. All the same, the device is to be suitable for high output and to enable a further conveyance of the collated printed products without substantial restrictions and a simple handover to a following conveying means.

This object is achieved by the device for collating of flat objects and for conveying of the objects to be collated further as defined in the independent claim. The dependent claims define preferred embodiments of the device.

The device according to the invention, like known devices for collating, includes a plurality of substantially continuously and circulatingly driven compartments, wherein a part of the circuit is designed as feeding region, i.e. runs parallel to a line of feeding outlets. Hereby, the compartments of the inventive device combine the advantages of the compartments of known continuously operating collating devices, in which the flat objects are stacked in a lying manner, with the advantages of such compartments in which the flat objects are stacked standing on one edge and they are equipped by means of a corresponding design and control for a conveying further with gradients and/or changes of direction and for a simple removal of the collated, flat objects.

The compartments of the device according to the invention driven in a circulating manner comprise a base, on which the fed printed products are stacked in a lying manner and at least one wall (transverse wall). Furthermore they are coupled to a conveying means (e.g. conveying chain) such that they are rotatable around at least one rotation axis, transverse to the conveying direction, and they advantageously include control means with the help of which they may be brought into different rotational positions in relation to the conveying means while circulating. At least in the feeding region, the compartments are orientated such that the at least one transverse wall is orientated transversally to the conveying direction and that the compartment bases are inclined towards the transverse wall in conveying direction. Transverse to the conveying direction, the compartment bases are e.g. orientated substantially horizontally. The compartments are conveyed in the named spatial position substantially in succession (possibly with a small overlap of less than 10%) through the feeding region, such that their openings are large enough for feeding without complex guiding of the objects to be stacked in the compartments and the fed objects are aligned on the transverse wall in relation to one another by gravity.

The compartments are e.g. rotatable around a rotation axis substantially horizontal to the conveying means or the circuit respectively, wherein the rotation axis is e.g. located in the region of the section line of the compartment base and transverse wall. Due to the rotation around this kind of rotation axis the compartments may be conveyed through the feeding region in the above mentioned position and in further conveying e.g. their inclination changed, without changing the inclination of the circuit and/or their inclination may be maintained, even if the circuit rises or falls.

In the same manner, the compartments may be rotatable around a rotation axis vertical in relation to the conveying means of the circuit respectively, such that the transverse wall is orientated transversely to the conveying direction during the conveyance through the feeding region and is upstream or downstream and that e.g. during further conveying the spatial orientation of the transverse wall remains the same even if the plan view of the circuit comprises changes of direction.

The control of the named rotatability of the compartments of the device, according to the invention, is e.g. implemented with control rollers, which are arranged on the compartments and roll off on stationary cams. For a product dependent adjustment of the position of the compartments e.g. in the feeding region and possibly also in other regions of the circuit of the compartments the position of such cams may be adjustable.

The compartments are advantageously narrower than the flat objects to be handled and/or comprise gaps in conveying direction, such that means for removing the stacked printed products from the compartments act on the objects laterally from the compartments and/or through the gaps from below and may lift them from the compartment bases.

The inclination angle of the compartment bases is as small as possible in the feeding region in order for the opening of the compartments to remain large. The inclination angle, however, is to be chosen large enough for gravity to at least support the alignment of the fed printed products. Depending on the objects to be handled, the inclination angle of the compartments in the feeding region is between 10° and 45°, advantageously 10° and 20°. The inclination angle of the compartment bases may be adapted in the feeding region by means of a corresponding adjustment, also to the friction coefficient and to the weight of the flat objects to be handled.

The device according to the invention is described in more detail in connection with the following figures.

DETAILED DESCRIPTION OF THE INVENTION

Figure 1:
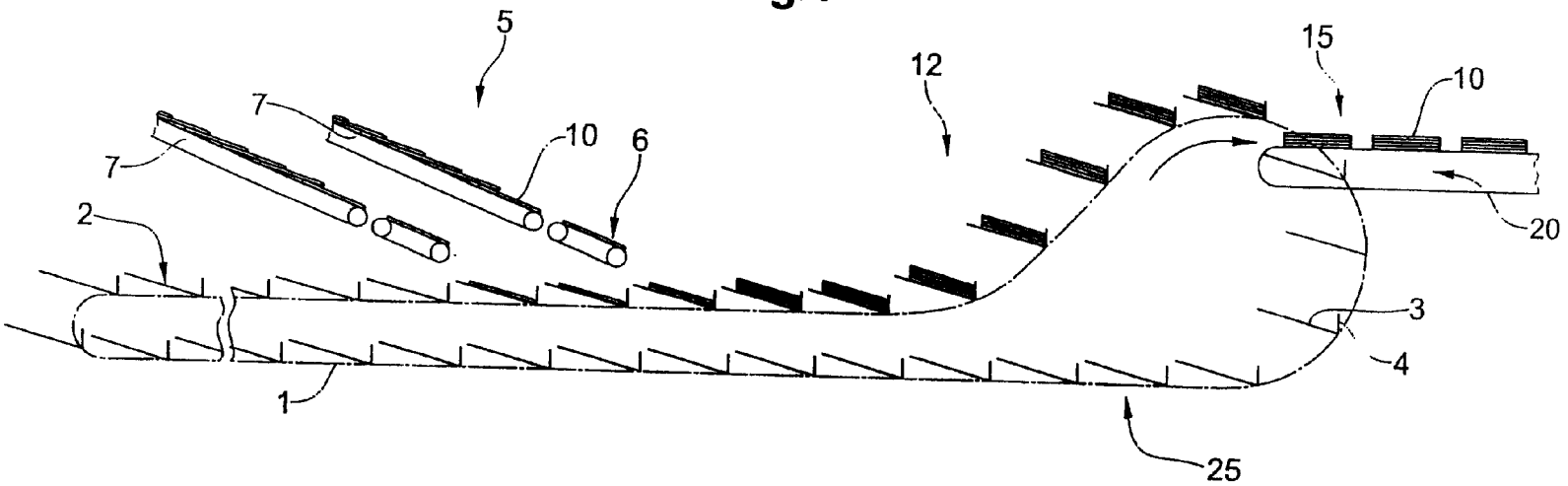
FIG. 1 shows a very diagrammatic representation of an exemplified embodiment of the device according to the invention in which the compartments are rotatable around a substantially horizontal rotation axis.

FIG. 1 shows in a very diagrammatic manner an exemplified embodiment of the device according to the invention viewed from the side. The device comprises, on a circuit 1 (broken line), substantially continuously circulating compartments 2, which comprise, at least in one feeding region 5 (in the upper part of the circuit) a base 2 inclined towards the front in a circulation direction and a downstream transverse wall 4. The circuit 1, in the feeding region 5, runs in parallel to a line of outlets 6 from feeding units 7 (only partly shown), with the aid of which printed products 10 are fed into the compartments 2 in identically orientated and synchronized manner. Hereby the feeding is advantageously controlled in a manner that the downstream edge of the printed products to be fed meets a downstream region of the compartment or the printed products already stacked in the compartment or the transverse wall 4 and that the speed of the impinging printed product is slightly higher than the speed of the compartments 2, such that the fed printed product is pushed towards the transverse wall 4 of the compartment 2 and, thus, is aligned to printed products fed before or after and remains aligned by gravity.

The compartments 2 are coupled to a conveying means (e.g. conveying chain or pair of conveying chains), such that they are rotatable in relation to the conveying means or the circuit 1 respectively around a substantially horizontally directed rotation axis. In a region 12 for conveying further, which comprises different gradients, following a feeding region 5, in which the conveying direction is e.g. horizontal, the compartments 2 with the printed products 10 stacked therein are maintained in the same spatial position by being rotated in relation to the conveying means or the circuit respectively. In other words, this means that the inclination angle of the compartments remains the same all the time. In an extraction region 15, following a conveying further region 12 in which the circuit has a gradient, i.e. where the compartments are conveyed downwards, the gradient angle of the compartment bases 3 is also maintained constant and the printed products 10 stacked in the compartments 2 are removed from the compartments 2 by means of an extraction means 20. The extraction region 15 is followed by a recirculation region 25, in which the compartments 2 are brought back into the feeding region 5.

In the recirculation region 25 the spatial position or the gradient respectively of the compartments is not relevant, except if individual stacks, e.g. due to faultiness, cannot be removed from their compartment in the extraction region 15 and need to be recirculated. In such a case, it is advantageous for the spatial position of compartments 2 to be maintained also in the recirculation region 25 or in parts of it, as shown in FIG. 1. Obviously, after the redirection into the recirculation region 25, the compartment bases are inclined to the back and the transverse wall 4 is upstream.

The compartments 2 of the device according to the invention are, as mentioned above, e.g. arranged on a conveying chain (not shown) circulating on the circuit 1 or on a pair of such conveying chains, wherein the compartments have regular distances between them. The compartments may also be coupled to loosely connected or mutually independent conveying elements, which are movable along rails, such that the compartments are at different distances from each other in different regions of their circuit. Compartments 2 conveyed independently to a limited degree, may e.g. be conveyed through the feeding region 5 at maximal distance from each other (no or only minor overlap of successive compartments with small gradients), in the extraction region 15 again at large mutual distances and in the region for further conveying 12 and in the recirculation region 25, in particular when the circuit rises in these regions, at a considerably smaller mutual distance (maximal overlap). In such a case also a region of rising or sloping gradient of the circuit 1 is suitable for buffering the compartments or for not loaded compartments (recirculation region) a horizontal region, in which the compartments have a large inclination angle and, thus, may be conveyed at very small mutual distances.

The compartments 2 shown in FIG. 1 comprise, in the feeding region 5 in conveying direction, compartment bases 3 inclining towards the front and a downstream transverse wall 4. The base gradient may also be directed towards the back, wherein the compartments comprise an upstream transverse wall and the feeding speed is to be smaller than the conveying speed of the compartments 2, such that the compartments catch up with an added product, which is thus pushed against the transverse wall and aligned to it.

Figure 2:
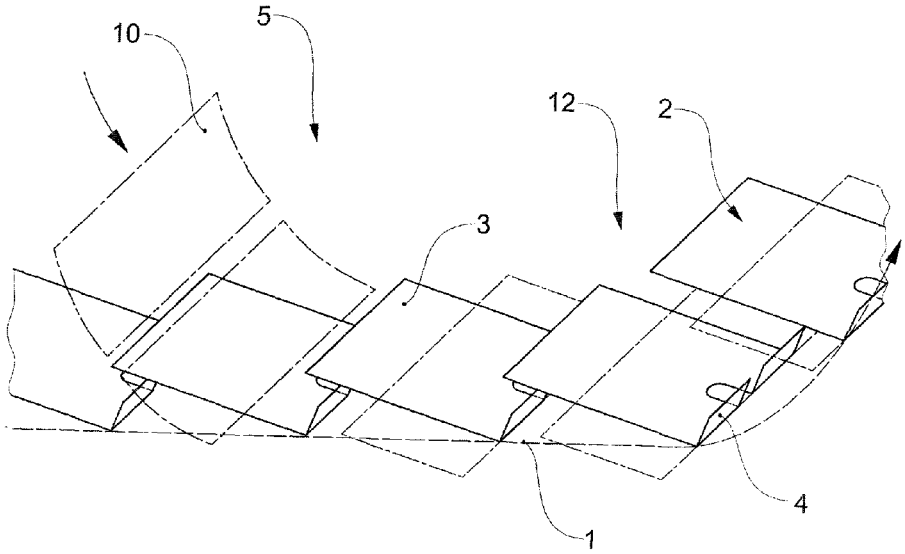
FIG. 2 shows the compartments of the device according to FIG. 1 in larger scale in the feeding region and in a conveying further region.

FIG. 2 shows more in detail the transition between the feeding region 5 and the region 12 for conveying further of the circuit 1 of the compartments 2 of the device according to FIG. 1. The compartments 2 are narrower than the printed products 10, which are fed into the compartments 2, such that the printed products protrude from the compartment base on both sides and may be lifted by an extraction means (not shown) in this region. As mentioned further above, gaps are possible for the same purpose, i.e. the compartments 2 consist of a plurality of mutually distanced parts, thus forming a gap, through which an extraction means may act on the printed products 10.

Figure 3:
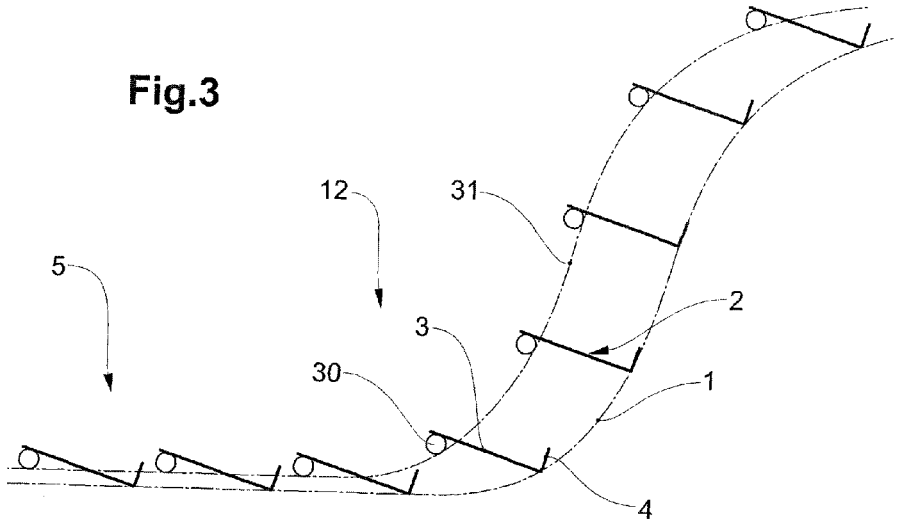
FIG. 3 shows a very diagrammatic representation of an exemplified control of the compartments of the device according to FIGS. 1 and 2 for the maintaining of the spatial position in a further conveying with changing upwards inclination.

FIG. 3 in very diagrammatic manner again shows the transition from the feeding region 5 to the further conveying region 12 of the compartments 2 of the device according to FIG. 1, wherein in particular an exemplified control is shown in which the compartments 2 are maintained in the same spatial position independently of the course of the circuit 1, which they have in the feeding region 5. The compartments 2 are mounted to a conveying means (not shown) such that they are, in relation to it, rotatable around the downstream edge of the compartment base 3 (substantially horizontal rotation axis). Under the upstream region of the base 3, control rollers 30 are arranged, which roll off on a stationary cam (broken line 31), when the compartments 2 move along the circuit 1. The distance between the cam 31 and the conveying organ or the circuit 1 is adapted to the gradient of the circuit 1 such that the gradient of the compartment bases 3 remains constant in independence of the gradient of the circuit. For adaptation of the inclination angle of the compartment bases to the printed products to be handled, the cam 31 may be adjustable.

Figure 4:
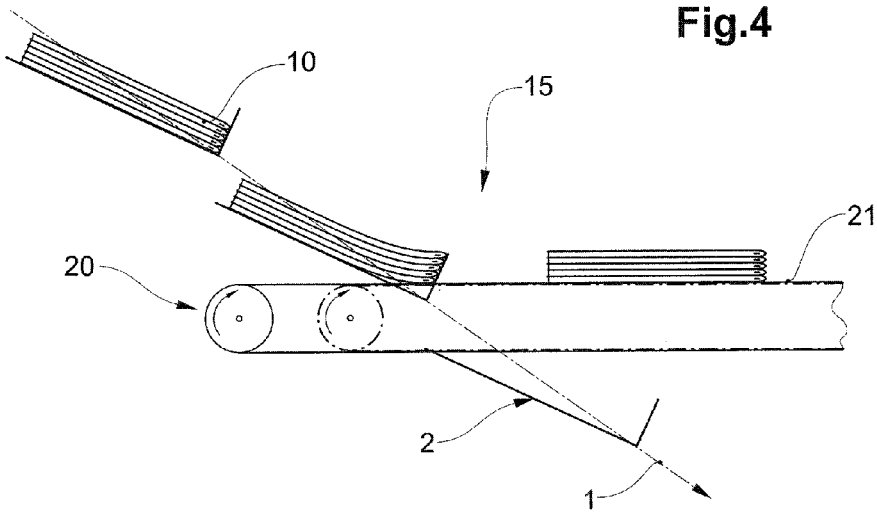
FIGS. 4 and 5 show examples of means for extraction of stacked printed products out of the compartments of the device according to FIGS. 1 and 2.
Figure 5:
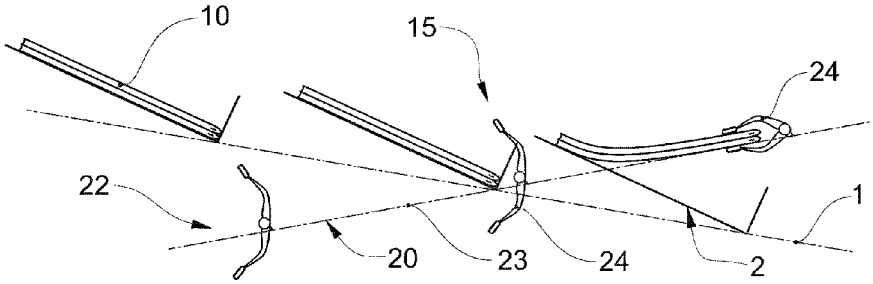

FIGS. 4 and 5 show two exemplified embodiments of extraction regions 15 of the device according to FIGS. 1 and 2. In these extraction regions 15, extraction means 20 are arranged, with which the printed products 10 stacked in the compartments 2 are removed. In both shown cases, the circuit 1 of the compartments 2 runs downwards through the extraction region at a constant inclination angle of the compartment bases and the printed products are lifted from the compartment bases by the extraction means 20.

FIG. 4 shows an extraction means 20, which is designed as a plurality of conveying belts 21 (only one is visible) circulating in parallel to each other. The bearing surface of the belts is substantially horizontal and dissects the circuit 1 of the compartments 2 leading downwards. The conveying belt 21 hereby acts laterally from the compartments 2 and/or through gaps in the compartments 2. The stacks conveyed in the compartments 10 are lifted one after the other from the compartment base and conveyed further successively on the conveying belts.

According to FIG. 5, the extraction means 20 is a very diagrammatically shown gripper-conveyor 22 or a plurality of gripper-conveyors. The circuit 23 of the gripper-conveyor 22 dissects the circuit 1 of the compartments 2 and the grippers 24 move laterally and/or in the gaps of the compartments 2. Furthermore, the control means (not shown) are provided, with the help of which the grippers 24 are, where they cross the compartments 2, closed. Advantageously the speeds of the compartments 2 and the gripper 24 are matched such that the stacks of printed products are pushed into the open grippers 24, before the grippers close and before the stack is lifted from the compartment base.

Figure 6:
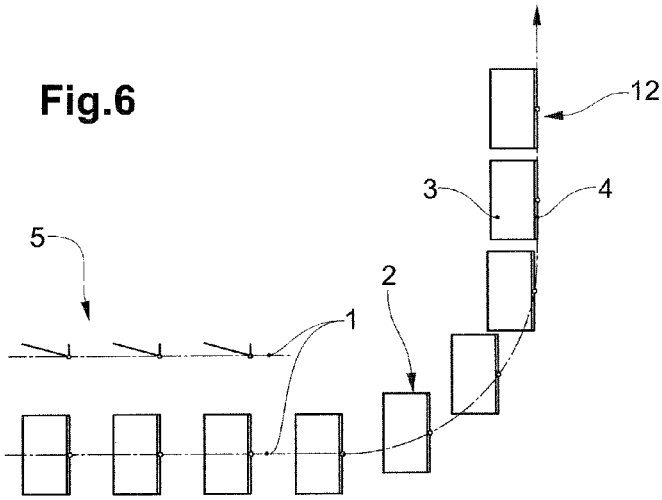
FIG. 6 shows a top view on the feeding region and a region of conveying further of a device according to the invention with compartments which are rotatable around a substantially vertical rotation axis.

FIG. 6 shows a further exemplified embodiment of the device according to the invention in a top view on a transition between the feeding region 5 and a region for further conveyance 12. The feeding region 5 is also shown as a side view, which shows that the compartments 2 are conveyed through the feeding region 5 in the same manner as shown in the preceding figures, i.e. with compartment bases sloping downwards to the front and a downstream transverse wall 4.

The compartments are rotatable around a substantially vertical rotation axis in relation to the conveying means or the circuit 1 respectively, such that they may maintain their spatial orientation through a change of direction in a horizontal plane, as shown in FIG. 6 for the region of further conveyance 12, in which the conveying direction is deflected by 90° in relation to the feeding region 5. The control of the compartments is in this case implemented in an actually known manner e.g. with the help of control rollers mounted to the compartments and corresponding stationary or adjustable cams.

Obviously, with a combination of rotatability around a substantially vertical rotation axis it becomes possible to maintain the spatial position and orientation of the compartments if the circuit is a three-dimensional structure. It also becomes possible not only to change the inclination angle of the compartment bases but also the direction of the inclination gradient in relation to the circuit, such that at constant conveying direction e.g. the inclination towards the front may be orientated towards the back or laterally.

Figure 7:
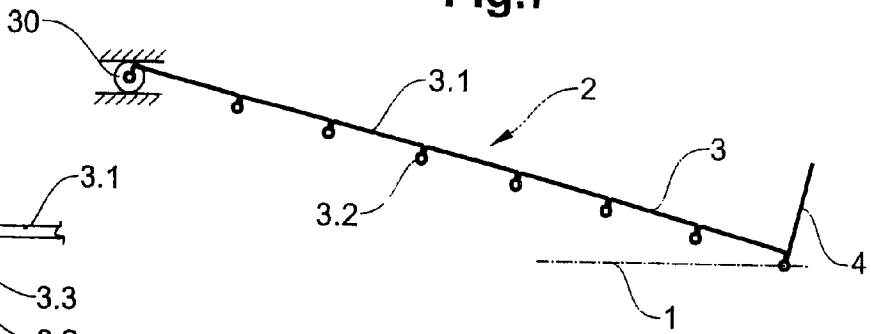
FIGS. 7 and 8 show an advantageous embodiment of the compartments for the device according to the invention.
Figure 8:
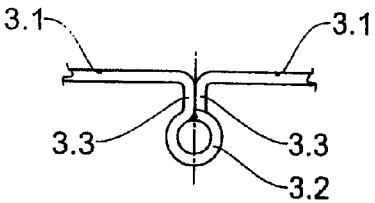

FIGS. 7 and 8 show an exemplified embodiment of the compartment 2 for the inventive device, as e.g. shown in the FIGS. 1 and 2. The compartment 2 is shown in a side view. The compartment base 3 consists of a plurality of floor elements 3.1, which, are connected to each other by means of hinges 3.2 such that the floor plane may be brought into a convex (curved towards the top) form, but not into a concave (curved towards the bottom) form. For this purpose, the floor pieces 3.1 comprise regions 3.3 curved downwards on both sides, on which the hinges 3.2 are arranged, as is shown at a slightly larger scale in FIG. 8. Advantageously the transverse wall 4 is also arranged to hinge on the base 3 and is held in its operative position by means of a return spring (not shown).

Figure 9:
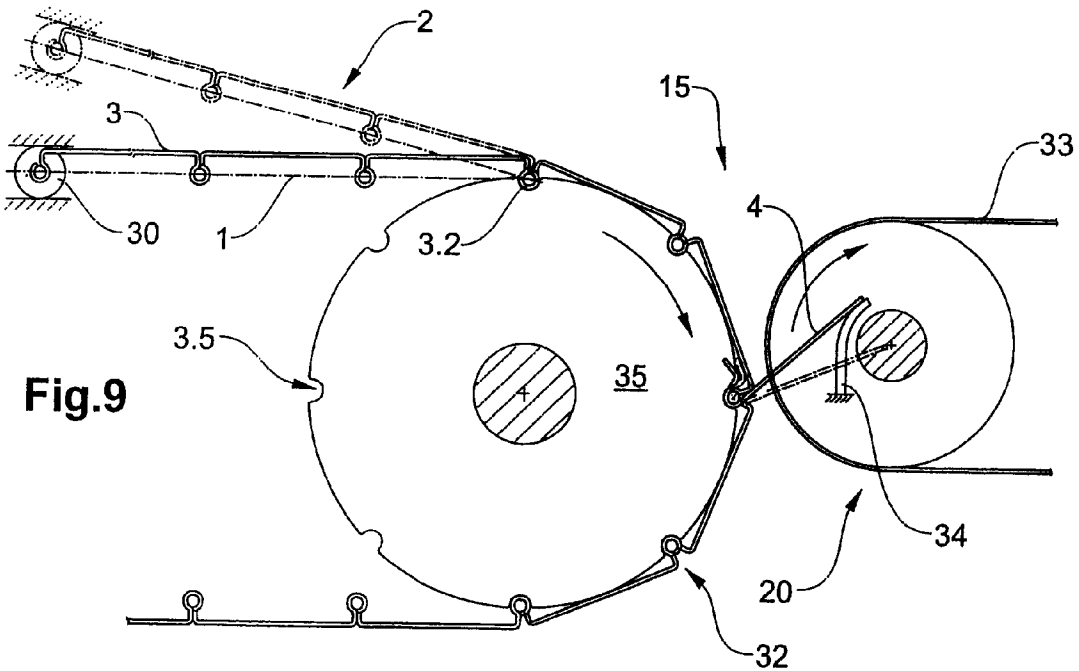
FIG. 9 shows a redirection of the compartments according to FIGS. 7 and 8.

FIG. 9 shows an extraction region 15, which is arranged in a redirection 32 of the circuit 1 of the compartments 2. The extraction means 20 is a conveying belt 33, which need not engage laterally or in gaps of the compartments, but simply connects to the upper hoistway of the compartment circuit 1. As the compartment bases 3 are flexible due to their hinges, the distance between the compartment redirection 32 and the extraction means 20 may be very small, such that also stacks with little rigidity may be removed safely. In order to enable the named distance to also be smaller than the height of the transverse walls 4 these are, as mentioned further above, arranged in a hinged manner on the compartment base 3 and in the region of the redirection 32 a control cam 34 is provided, with the help of which the transverse walls 4 are rotated towards the compartment base 3 against the force of the not shown return spring and in this rotated position are moved between the deflection wheel 35 and the extraction means 20.

FIG. 9 also shows how the hinges 3.2 may co-operate with corresponding recesses 3.5 of the redirection wheel 35 for the drive of the compartments 2.

Obviously the compartments shown in FIGS. 7 to 9, the base planes of which may be brought into a convex form, are also applicable in very simple devices, in which the compartments 2 are neither rotatable around a substantially horizontal nor a substantially vertical rotation axis in relation to conveying means or circuit.

Figure 10:
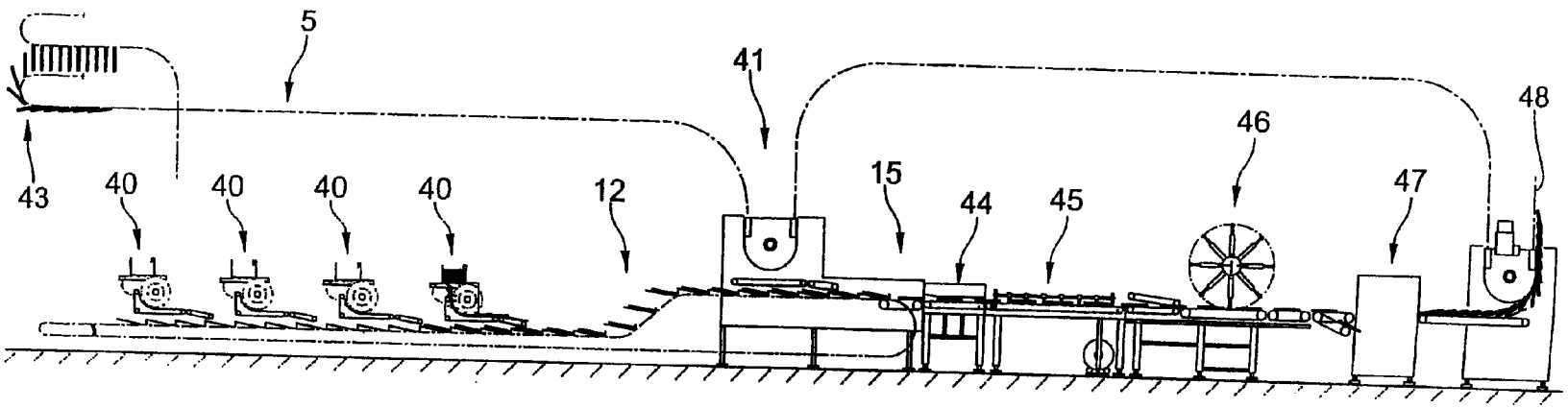
FIG. 10 shows an exemplified application of the device according to the invention.

FIG. 10 shows an exemplified application of the device according to the invention. This is a production installation for production of printed products with other flat objects integrated, wrapped in film, wherein the groups are e.g. units ready for dispatch, which e.g. comprise a newspaper or magazine, possibly with inserted supplements as main products as well as four further supplements such as printed sheets, brochures, booklets, CDs, flat product samples or slips pasted to these (Memostick®) or cards in the form of a stack. For the feeding of printed products to be pasted similar devices to those for the feeding of the other objects are applied in known manner. In addition, an in fact known device is provided with which an adhesive agent is applied and activated and with which the printed product to be pasted is pressed onto the object beneath it in the stack.

In the installation according to FIG. 10, the device according to the invention comprises four feeders 40 acting as feeding units as well as an on-line-feeder 41 which e.g. feeds the main product out of a processing device 43 (e.g. inserting drum, collecting drum, cutting machine) and forms the last feeding unit in the collating direction. The shown feeders 40 are arranged directly above the circuit of the compartments. The feeders may also be arranged laterally to the circuit, wherein an e.g. looped intermediate conveyor leads the printed products individualized by the feeder over the compartments and dispenses them into these.

Between the feeding units 40 and the on-line-feeder 41 a rising region 12 for further conveying is arranged. In the extraction region 15 the collated objects, in the manner shown in FIG. 4, are taken over by conveying belts. Then they are e.g. held in a device 44 between two tapes and e.g. positioned on a web of film. The web of film is then wrapped around the successive stacks (wrapping region 45). With the aid of a welding device 46, the film wrapped around the stacks is welded lengthwise and transversally and separated. The individual packages formed through the separation are then ordered into a scaled stream (device 47), which is then taken over by a gripper conveyor.

The main product, which possibly also carries the address of the receiver of the completed package, is, as is shown in FIG. 10, advantageously fed last and with the title page on top, such that it is clearly visible in the completed package. It is, however, also possible to feed the main product with the title page towards the bottom, i.e. to arrange the on-line feeding in conveying direction as first feeding unit.

The invention claimed is:

1. Device for collating flat objects, in particular printed products, and for conveying the collated objects further, comprising:

a plurality of feeding units for feeding the objects;

a plurality of compartments circulating on a circuit for collating the fed objects, wherein the circuit comprises regions with different gradients;

a conveyor for conveying the compartments along the circuit and for the substantially continuous conveyance at least through a feeding region of the circuit, wherein outlets of the feeding units in the feeding region are arranged successively in a line and wherein the circuit of the compartments runs in parallel to the named line in the feeding region; and an extractor for removal of the collated objects out of the compartments in an extraction region of the circuit;

wherein the compartments comprise compartment bases for the lying stacking of the objects, at least one object to be oriented with a main surface lying on the base, and a transverse wall and are coupled to the conveyor, such that the compartment bases, at least in the feeding region, are inclined with respect to the horizontal direction and are conveyable in a manner arranged with the transverse wall in transverse to the circuit and such that the compartments are pivotable in relation to the circuit around substantially horizontal and/or around a substantially vertical pivot axis, wherein an angle between a compartment base and the circuit in a first region of the circuit is different from that in another region, and wherein the base is a longer portion of the compartment as compared to the transverse wall.

2. Device according to claim 1, wherein in the feeding region an inclination angle of the compartment bases is between 10° and 45° with respect to the horizontal direction.

3. Device according to claim 2, wherein the inclination angle of the compartment bases is adjustable by means of pivoting around the substantially horizontal pivot axis.

4. Device according to claim 1, wherein at least in the feeding region the compartment bases are inclined forward as seen in the conveying direction and wherein the transverse wall is leading.

5. Device according to claim 1, wherein the circuit, comprises a recirculation region with declining and/or inclining gradients and wherein in at least part of the recirculation region, control means are provided, by which the compartments are pivoted in relation to the circuit around the substantially horizontal pivot axis that they maintain their inclination angle from the feeding region.

6. Device according to claim 1, wherein the circuit comprises a layout with changes of direction and that at least in regions with changes of direction control means are provided by which the compartments are pivoted around the substantially vertical pivot axis, such that their spatial orientation from before the change of direction is maintained.

7. Device according to claim 1, wherein the conveyor comprises a circulating conveying organ on which the compartments are arranged at regular distances.

8. Device according to claim 1, wherein the conveyor comprises a plurality of conveying elements as well as driving elements for driving the conveying elements, wherein a compartment is coupled to each conveying element and wherein the conveying elements are conveyable along the circuit at different mutual distances.

9. Device according to claim 1, wherein at least a part of the feeding units are feeders or on-line-feeders.

10. Device according to claim 1, wherein the compartment bases are flexible, such that their base planes may be brought into a convex, but not a concave form.

11. Device according to claim 10, wherein the compartment bases comprise a plurality of base parts connected in a hinged manner.

12. Device according to claim 10, wherein the transverse walls are fixed to the compartment bases in a hinged manner.

13. Device according to claim 1, wherein the device is integrated in an installation for production of groups of flat objects wrapped in film.

14. Use of the device according to claim 1 for production of groups of flat objects, wherein the objects are newspapers, magazines individual folded or not folded sheets, CDs, flat product samples, cards and/or slips or cards pasted to one of the named objects.

15. Device for collating flat objects, in particular printed products, and for conveying the collated objects further, comprising:

a plurality of feeding units for feeding the objects;

a plurality of compartments circulating on a circuit for collating the fed objects;

a conveyor for conveying the compartments along the circuit and for the substantially continuous conveyance at least through a feeding region of the circuit, wherein outlets of the feeding units in the feeding region are arranged successively in a line and wherein the circuit of the compartments runs in parallel to the named line in the feeding region; and an extractor for removal of the collated objects out of the compartments in an extraction region of the circuit;

wherein the compartments comprise compartment bases for the lying stacking of the objects and a transverse wall and are coupled to the conveyor, such that the compartment bases, at least in the feeding region, are inclined with respect to the horizontal direction and are conveyable in a manner arranged with the transverse wall in transverse to the circuit and such that the compartments are pivotable in relation to the circuit around substantially horizontal and/or around a substantially vertical pivot axis, and wherein the circuit of compartments, between the feeding region and the extraction region or between parts of the feeding region, comprises at least one region for further conveying, in which the circuit comprises an upward or downward gradient, and wherein the region for further conveying is provided with control means by which the compartments are pivoted in relation to the circuit around the substantially horizontal pivot axis in a manner that the inclination angle from the feeding region is maintained.

16. Device for collating flat objects, in particular printed products, and for conveying the collated objects further, comprising:

a plurality of feeding units for feeding the objects;

a plurality of compartments circulating on a circuit for collating the fed objects; a conveyor for conveying the compartments along the circuit and for the substantially continuous conveyance at least through a feeding region of the circuit, wherein outlets of the feeding units in the feeding region are arranged successively in a line and wherein the circuit of the compartments runs in parallel to the named line in the feeding region; and an extractor for removal of the collated objects out of the compartments in an extraction region of the circuit;

wherein the compartments comprise compartment bases for the lying stacking of the objects, at least one object to be oriented with a main surface lying on the base, and a transverse wall and are coupled to the conveyor, such that the compartment bases, at least in the feeding region, are inclined with respect to the horizontal direction and are conveyable in a manner arranged with the transverse wall in transverse to the circuit and such that the compartments are pivotable in relation to the circuit around substantially horizontal and/or around a substantially vertical pivot axis, wherein the base is a longer portion of the compartment as compared to the transverse wall; and wherein the circuit of the compartments leads downwards in the extraction region and wherein in the extraction, region control means are provided by which the compartments are pivoted in relation to the circuit around the substantially horizontal pivot axis, such that their inclination angle from the feeding region is maintained.

17. Device according to claim 16, wherein the extractor is arranged in the extraction region such that it lifts the objects to be collated from the side of the compartments or through gaps in the compartments off the compartment bases.

18. Device according to claim 17, wherein the extractor comprises a plurality of conveying belts circulating in parallel with a substantially horizontal bearing surface.

19. Device for collating flat objects, in particular printed products, and for conveying the collated objects further, comprising:

a plurality of feeding units for feeding the objects;

a plurality of compartments circulating on a circuit for collating the fed objects;

a conveyor for conveying the compartments along the circuit and for the substantially continuous conveyance at least through a feeding region of the circuit, wherein outlets of the feeding units in the feeding region are arranged successively in a line and wherein the circuit of the compartments runs in parallel to the named line in the feeding region; and an extractor for removal of the collated objects out of the compartments in an extraction region of the circuit;

wherein the compartments comprise compartment bases for the lying stacking of the objects and a transverse wall and are coupled to the conveyor, such that the compartment bases, at least in the feeding region, are inclined with respect to the horizontal direction and are conveyable in a manner arranged with the transverse wall in transverse to the circuit and such that the compartments are pivotable in relation to the circuit around substantially horizontal and/or around a substantially vertical pivot axis, and wherein the extractor comprises a gripper-conveyor or a plurality of gripper-conveyors circulating in parallel, wherein a circuit of the gripper-conveyors crosses the circuit of the compartments.

* * * * *